US010717499B1

(12) United States Patent
Street et al.

(10) Patent No.: US 10,717,499 B1
(45) Date of Patent: Jul. 21, 2020

(54) SIDEWALL-SUSPENDED BOAT COOLER

(71) Applicants: Danny Street, Brooksville, FL (US); Dan Street, Brooksville, FL (US)

(72) Inventors: Danny Street, Brooksville, FL (US); Dan Street, Brooksville, FL (US)

( * ) Notice: Subject to any disclaimer, the term of this patent is extended or adjusted under 35 U.S.C. 154(b) by 85 days.

(21) Appl. No.: 16/174,357

(22) Filed: Oct. 30, 2018

(51) Int. Cl.

| | |
|---|---|
| ***B63B 25/00*** | (2006.01) |
| ***B65D 81/38*** | (2006.01) |
| ***B65D 25/22*** | (2006.01) |
| ***B65D 43/16*** | (2006.01) |
| ***B65D 25/28*** | (2006.01) |
| ***B65D 25/04*** | (2006.01) |

(52) U.S. Cl.
CPC ..... *B63B 25/004* (2013.01); *B65D 25/04* (2013.01); *B65D 25/22* (2013.01); *B65D 25/2841* (2013.01); *B65D 43/165* (2013.01); *B65D 81/3816* (2013.01)

(58) Field of Classification Search
CPC . B63B 2017/0054; B63B 25/004; B60N 3/10; B60N 3/103; F25D 23/10
See application file for complete search history.

(56) References Cited

U.S. PATENT DOCUMENTS

| | | | | | |
|---|---|---|---|---|---|
| 4,146,279 | A | | 3/1979 | Stahel | |
| D267,444 | S | * | 1/1983 | Ruxton | D12/419 |
| D273,056 | S | | 3/1984 | Lennon | |
| 4,593,642 | A | * | 6/1986 | Shay | B63B 34/20 114/347 |
| 5,050,526 | A | * | 9/1991 | Nelson | A01K 63/02 114/364 |
| 5,112,094 | A | * | 5/1992 | Kribs | B60N 2/75 296/37.8 |
| 5,165,198 | A | | 11/1992 | Kilan, III | |
| 5,492,068 | A | * | 2/1996 | McKee | B60N 2/793 108/44 |
| 6,035,800 | A | | 3/2000 | Clifford | |
| 6,367,403 | B1 | | 4/2002 | Carter | |
| 7,029,048 | B1 | * | 4/2006 | Hicks | B60N 3/101 296/193.04 |
| 7,293,518 | B1 | * | 11/2007 | Gassew | A01K 97/10 114/219 |
| 8,371,548 | B1 | | 2/2013 | Bishop | |
| D703,007 | S | | 4/2014 | McCarthy | |
| 9,150,353 | B2 | | 10/2015 | Jackson | |

(Continued)

FOREIGN PATENT DOCUMENTS

| | | |
|---|---|---|
| WO | 2016210377 | 12/2016 |

*Primary Examiner* — Brian D Nash
(74) *Attorney, Agent, or Firm* — Kyle A. Fletcher, Esq.

(57) ABSTRACT

The sidewall-suspended boat cooler is a cooler comprising a container and a lid. The container has an asymmetric layout comprising a front compartment and a rear descending wall overhang where the front compartment and the rear descending wall overhang are separated by a U-shaped space that mates with a gunwale or sidewall of a vessel. The lid is hingedly coupled to the rear of the container and a seal provides an airtight barrier between the container and the lid. The container and the lid are insulated to maintain the temperature of items stored within the cooler. Handles on the side of the cooler allow it to be conveniently carried. The sidewall-suspended boat cooler may further comprise an organizer on the exterior front wall and a cargo net the hangs adjacent the front of the container.

17 Claims, 5 Drawing Sheets

(56) References Cited

U.S. PATENT DOCUMENTS

| | | | | |
|---|---|---|---|---|
| 10,173,609 | B1 * | 1/2019 | Grimes | B60R 11/06 |
| 2001/0030436 | A1 * | 10/2001 | Kifer | B60R 7/04<br>296/24.34 |
| 2005/0035618 | A1 * | 2/2005 | Toth | B60N 3/101<br>296/24.34 |
| 2005/0248169 | A1 * | 11/2005 | Clark | B60N 3/101<br>296/24.34 |
| 2006/0231716 | A1 * | 10/2006 | Liu | B60R 7/04<br>248/311.2 |

* cited by examiner

SIDEWALL-SUSPENDED BOAT COOLER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of food and beverage coolers and boating equipment, more specifically, a sidewall-suspended boat cooler.

SUMMARY OF INVENTION

The sidewall-suspended boat cooler is a cooler comprising a container and a lid. The container has an asymmetric layout comprising a front compartment and a rear descending wall overhang where the front compartment and the rear descending wall overhang are separated by a U-shaped space that mates with a gunwale or sidewall of a vessel. The lid is hingedly coupled to the rear of the container and a seal provides an airtight barrier between the container and the lid. The container and the lid are insulated to maintain the temperature of items stored within the cooler. Handles on the side of the cooler allow it to be conveniently carried. The sidewall-suspended boat cooler may further comprise an organizer on the exterior front wall and a cargo net the hangs at the front of the container.

An object of the invention is to provide an insulated cooler to maintain the temperature of stored items.

Another object of the invention is to provide a U-shaped space beneath the cooler for mating the cooler with the sidewall or gunwale of a vessel.

A further object of the invention is to provide an organizer on the front of the cooler.

Yet another object of the invention is to provide a cargo net adjacent a front of the cooler.

These together with additional objects, features and advantages of the sidewall-suspended boat cooler will be readily apparent to those of ordinary skill in the art upon reading the following detailed description of the presently preferred, but nonetheless illustrative, embodiments when taken in conjunction with the accompanying drawings.

In this respect, before explaining the current embodiments of the sidewall-suspended boat cooler in detail, it is to be understood that the sidewall-suspended boat cooler is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the sidewall-suspended boat cooler.

It is therefore important that the claims be regarded as including such equivalent construction insofar as they do not depart from the spirit and scope of the sidewall-suspended boat cooler. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
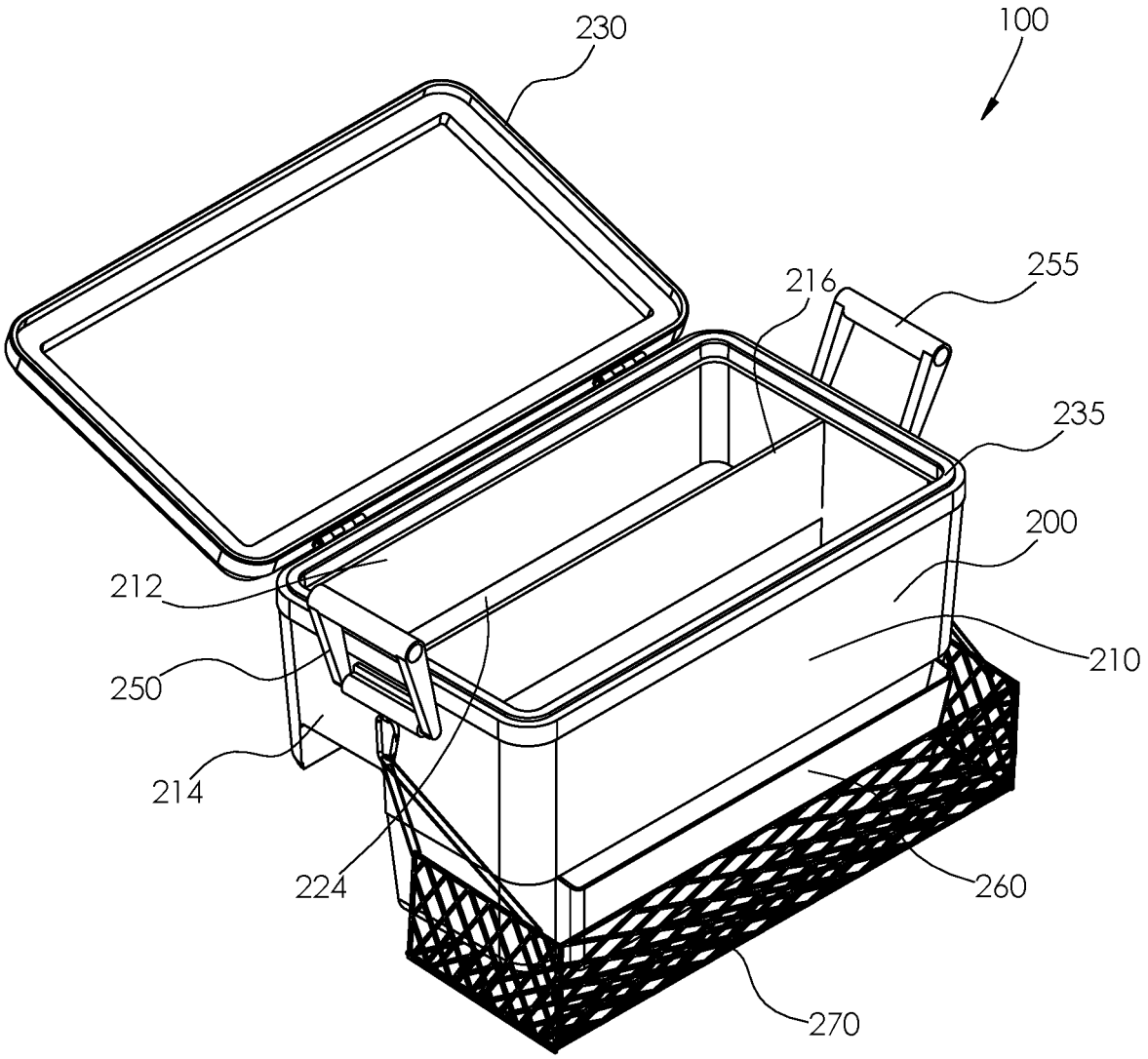
FIG. 1 is a perspective view of an embodiment of the disclosure.
Figure 2:
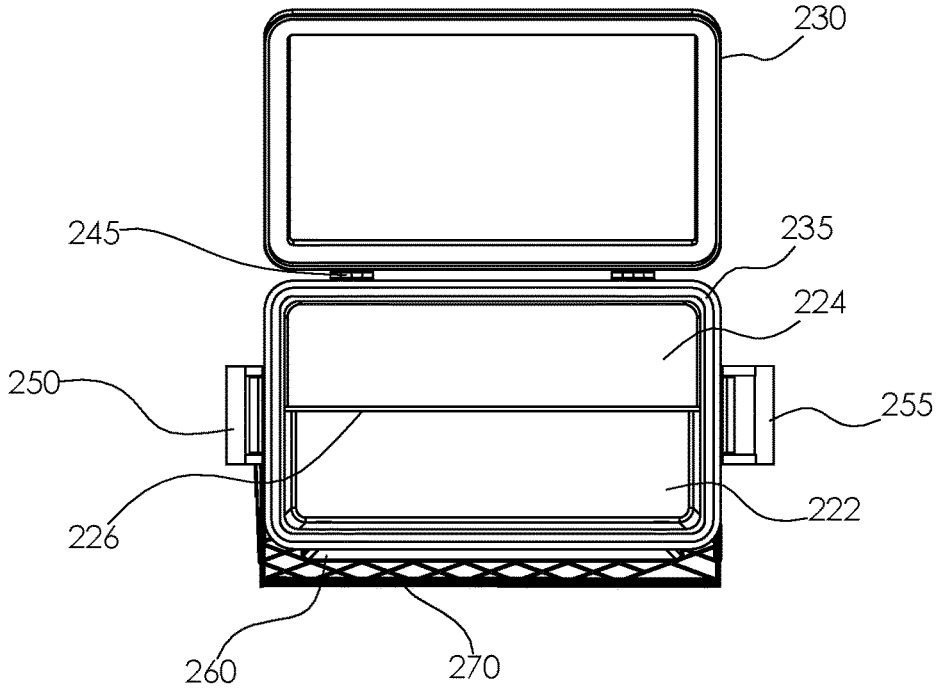
FIG. 2 is a top view of an embodiment of the disclosure.
Figure 3:
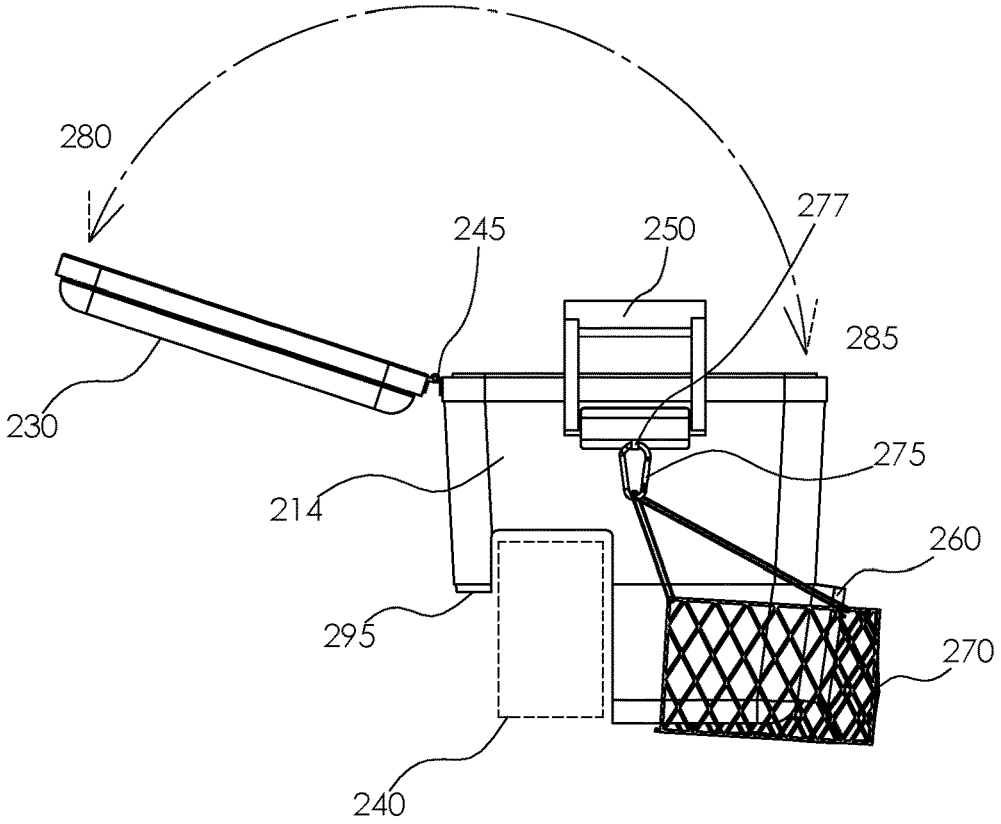
FIG. 3 is a side view of an embodiment of the disclosure.
Figure 4:
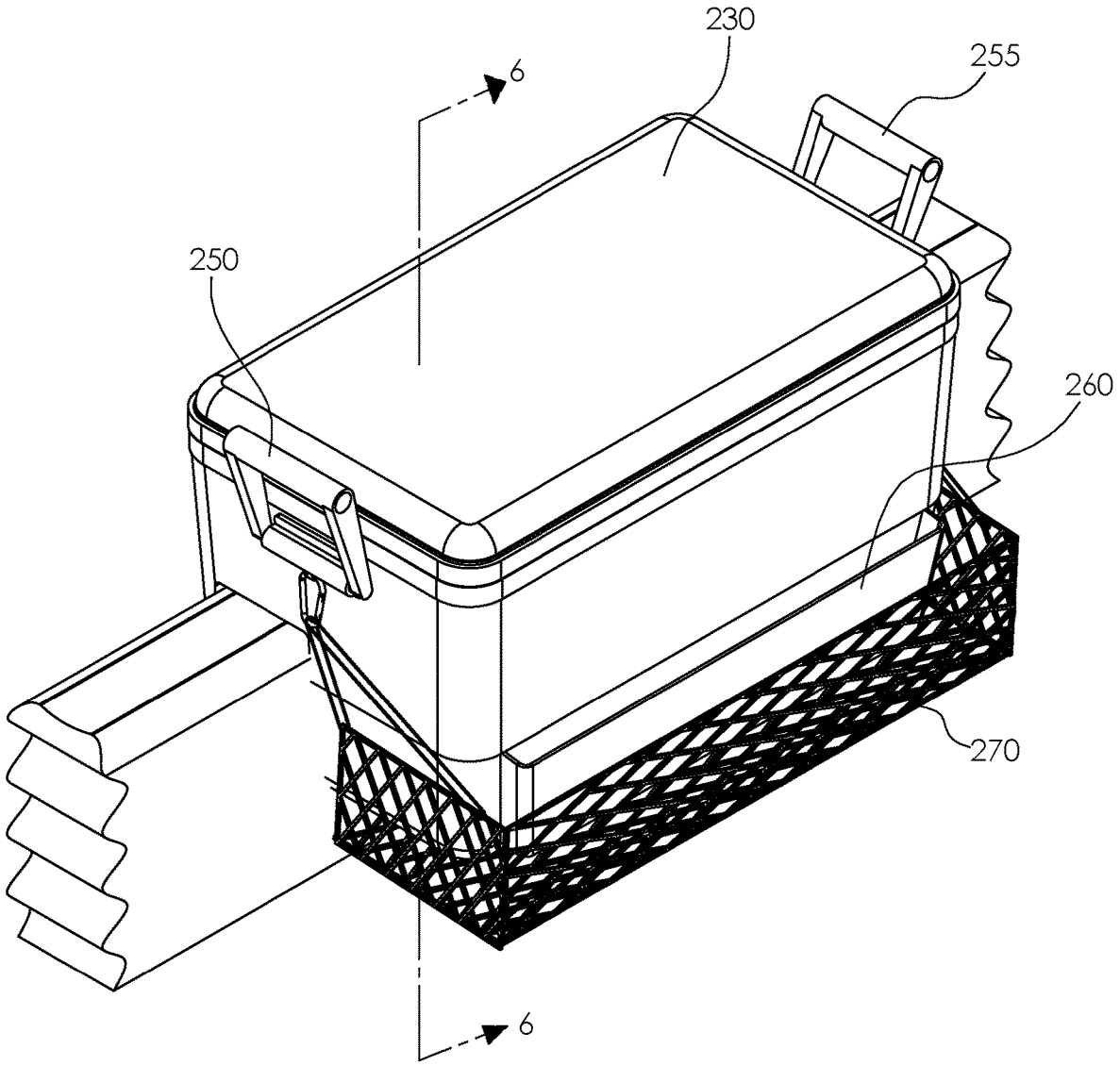
FIG. 4 is an in-use view of an embodiment of the disclosure illustrating a closed cooler mounted onto the sidewall of a vessel.
Figure 5:
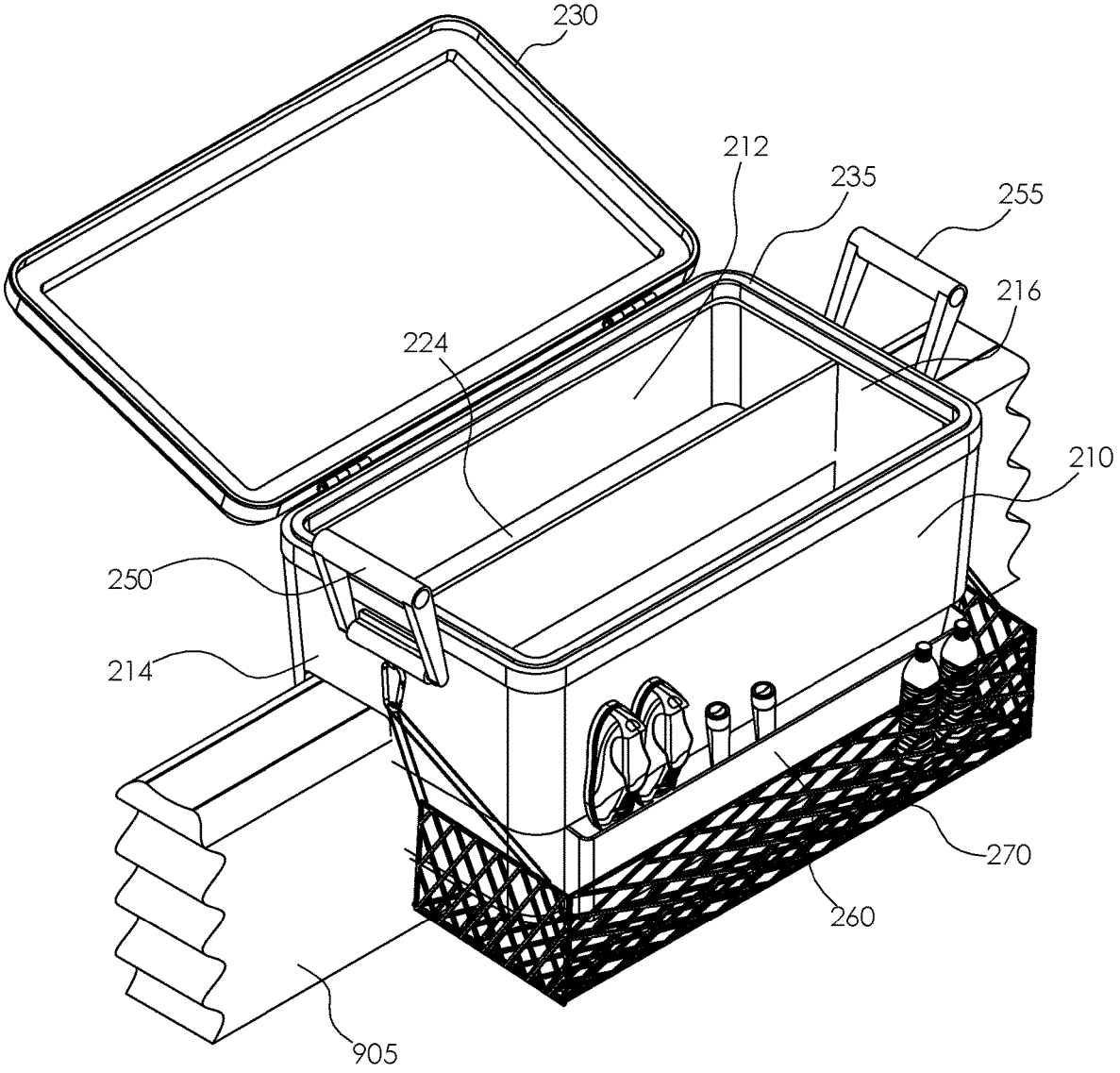
FIG. 5 is an in-use view of an embodiment of the disclosure illustrating an open cooler mounted onto the sidewall of a vessel with items stored in the organized and cargo net.
Figure 6:
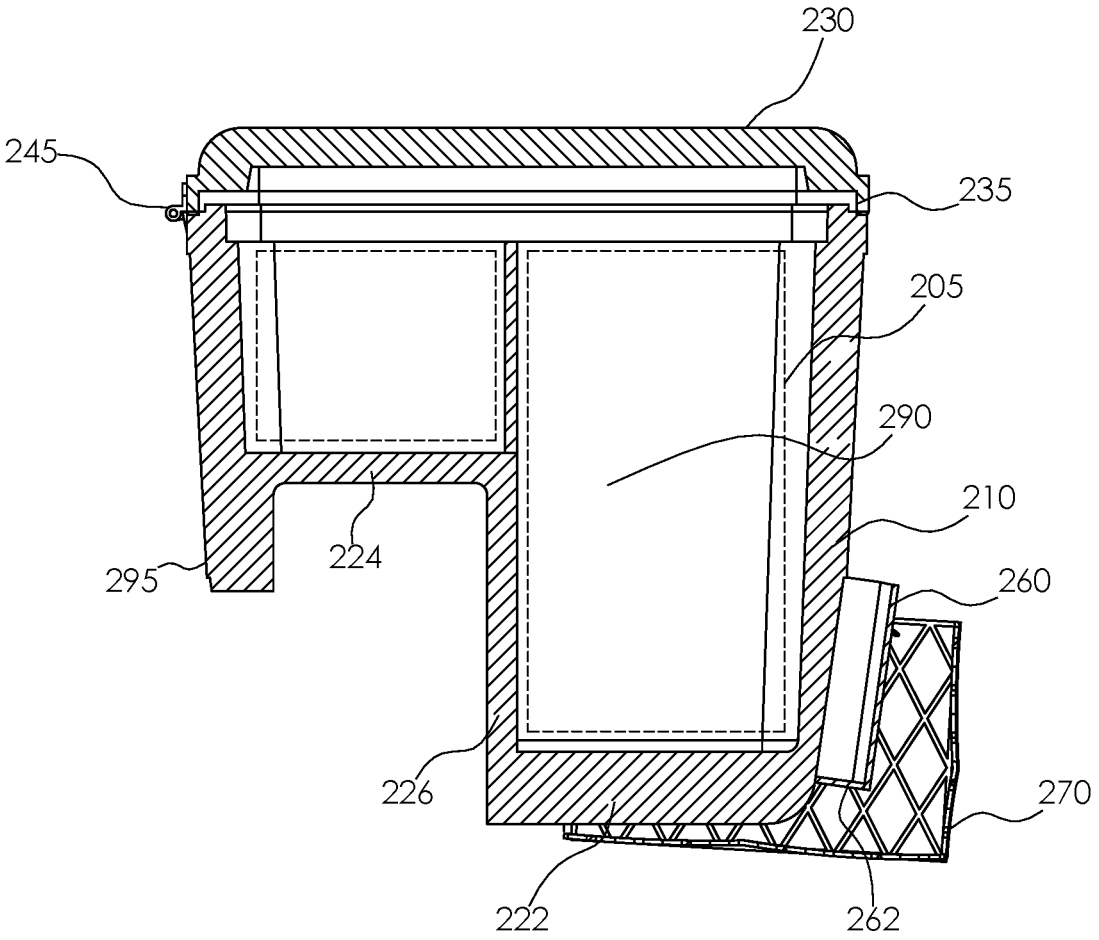
FIG. 6 is a cross-sectional view of an embodiment of the disclosure across 6-6 as shown in FIG. 4.

Detailed reference will now be made to a first potential embodiment of the disclosure, which is illustrated in FIGS. 1 through 6.

The sidewall-suspended boat cooler 100 (hereinafter invention) comprises a container 200 and a lid 230. The container 200 and the lid 230 may be insulated to maintain the temperature of items placed within the container 200. The container 200 may have an asymmetric layout comprising a front compartment 290 and a rear descending wall overhang 295 where the front compartment 290 and the rear descending wall overhang 295 are separated by a U-shaped space 240 that mates with a gunwale or sidewall 905 of a vessel.

Throughout this document, left and right are directional references taken with respect to a user standing in front of the invention 100. The left side of the invention 100 is on the same side as the user's left and the right side of the invention 100 is on the same side as the user's right. The front of the invention 100 is the side that is opposite one or more hinges 245.

The container 200 comprises a front wall 210, a rear wall 212, a left wall 214, a right wall 216, and a bottom. The front wall 210, the left wall 214, the rear wall 212, and the right wall 216 may be vertically oriented walls that couple to each other to surround the container 200. The tops of the front wall 210, the left wall 214, the rear wall 212, and the right wall 216 may define an access opening through which the items may be placed into or removed from the container 200.

The bottom may comprise an upper surface 224, a lower surface 222, and a transition wall 226. The upper surface 224 may be a horizontally oriented surface that couples to the rear wall 212, the left wall 214, and the right wall 216. The lower surface 222 may be a horizontally oriented surface that couples to the front wall 210, the left wall 214, and the right wall 216. Specifically, the lower surface 222 may be coupled to the bottom of the front wall 210, the bottom of the left wall 214, and the bottom of the right wall 216 and may define the deepest portion of an interior 205 of the container 200. The transition wall 226 and the upper surface 224, in conjunction with the rear wall 212 of the container 200, define the U-shaped space 240 when viewed from a side of the container 200. The invention 100 may be supported by the gunwale or sidewall 905 by placing the invention 100 on top of the gunwale or sidewall 905 and lowering the container 200 onto the gunwale or sidewall 905 such that the U-shaped space 240 straddles the gunwale or sidewall 905 with the rear wall 212 on one side of the gunwale or sidewall 905 and the front compartment 290 on the other side of the gunwale or sidewall 905.

The lid 230 may be a covering for the invention 100 that is hingedly coupled to the rear wall 212 of the container 200 via the one or more hinges 245. The lid 230 may pivot between an open position 280 and a closed position 285. When in the open position 280, the items may be placed into or removed from the container 200. When in the closed position 285, the lid 230 and the container 200 form a thermal barrier surrounding the items within the container 200.

The front wall 210, the left wall 214, the rear wall 212, the right wall 216, the bottom, and the lid 230 may be composed of or filled with a thermally insulating material. As a non-limiting examples, the front wall 210, the left wall 214, the rear wall 212, the right wall 216, the bottom, and the lid 230 may be filled with polystyrene, polyurethane, cellulose, mineral wool, fiberglass, air, another insulating material, or combinations thereof.

A seal 235 may be coupled to the access opening at the tops of the front wall 210, the left wall 214, the rear wall 212, and the right wall 216. The seal 235 may prevent air from entering or exiting the interior 205 of the container 200 when the lid 230 is closed.

The front wall 210, the left wall 214, the right wall 216, the lower surface 222, the transition wall 226, and the lid 230 may define the front compartment 290 which may be the front section of the invention 100. The front compartment 290 may define the largest storage area for the items placed within the container 200. The front compartment 290 may include all space in the interior 205 of the container 200 directly above the lower surface 222 and extending from the lower surface 222 to the lid 230.

A lesser amount of storage space may be proved adjacent to the front compartment 290 at the rear of the container 200 in the space directly above the upper surface 224 and extending from the upper surface 224 to the lid 230

A left handle 250 may be hingedly coupled to the exterior of the left wall 214 and a right handle 255 may be hingedly coupled to the exterior of the right wall 216. The invention 100 may be lifted and carried using the left handle 250 and the right handle 255.

The invention 100 may further comprise an organizer 260. The organizer 260 may provide storage space on the exterior of the container 200 for the items that do not require thermal protection. As non-limiting examples, the organizer 260 may provide storage space for sunglasses, tubes of sunscreen, and flip-flops. The organizer 260 may be a wall projecting from the front wall 210 on the exterior of the container 200. The vertical height of the organizer 260 may be lower than the vertical height of the front wall 210. The organizer 260 may be U-shaped when viewed from above. The organizer 260 may have an organizer bottom 262 to prevent the items laced in the organizer 260 from falling through. In some embodiments, the organizer bottom 262 may comprise apertures for water to drain out of the organizer 260.

The invention 100 may further comprise a cargo net 270. The cargo net 270 may provide additional storage outside of the container 200. As a non-limiting example, the cargo net 270 may be well suited for storing the items that are wet. The cargo net 270 may be a mesh barrier that hangs adjacent to the front, exterior of the container 200. The cargo net 270 may couple to the container 200 via a net mounting hardware. In some embodiments, the net mounting hardware may comprise a plurality of net hooks 277 located on the exterior of the container 200 that mate with a plurality of net hanging clips 275 coupled to the cargo net 270.

In use, the container 200 is placed onto the gunwale or sidewall 905 of the vessel such that the U-shaped space 240 rests upon the top of the gunwale or sidewall 905. Ice may be placed into the container 200 to chill the items stored in the container 200. The lid 230 may be closed to maintain the temperature within the container 200 or opened to add or remove the items. Non-refrigerated items may be stored in the organizer 260 located on the front of the container 200. Damp items may be placed in the cargo net 270 to air dry.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, an "aperture" is an opening in a surface. Aperture may be synonymous with hole, slit, crack, gap, slot, or opening.

As used herein, the words "couple", "couples", "coupled" or "coupling", refer to connecting, either directly or indirectly, and does not necessarily imply a mechanical connection.

As used in this disclosure, the word "exterior" is used as a relational term that implies that an object is not located or contained within the boundary of a structure or a space.

As used herein, "front" indicates the side of an object that is closest to a forward direction of travel under normal use of the object or the side or part of an object that normally presents itself to view or that is normally used first. "Rear" or "back' refers to the side that is opposite the front.

As used in this disclosure, a "handle" is an object by which a tool, object, or door is held or manipulated with the hand.

As used in this disclosure, "horizontal" is a directional term that refers to a direction that is perpendicular to the local force of gravity. Unless specifically noted in this disclosure, the horizontal direction is always perpendicular to the vertical direction.

As used in this disclosure, the word "interior" is used as a relational term that implies that an object is located or contained within the boundary of a structure or a space.

As used in this disclosure, a "lid" is a movable or removable cover that is placed on a hollow structure to contain and/or protect the contents within the hollow structure.

As used herein, "mate" refers to coupling at a predefined interface.

As used in this disclosure, the term "mesh" refers to an openwork fabric made from threads, yarns, cords, wires, strands, or lines that are woven, knotted, twisted, or otherwise intertwined at regular intervals. A mesh may also be referred to as a net.

As used herein, "mounting hardware" refers to mechanical devices that are used to attach one object to another, including devices whose only purpose is to improve aesthetics. As non-limiting examples, mounting hardware may include screws, nuts, bolts, washers, crossbars, hooks, collars, nipples, standoffs, knobs, caps, plates, rails, and brackets.

As used herein, "net" refers to an open-mesh structure that is twisted, knotted, or woven together at regular intervals. A net may be used as a barrier that blocks the passage of large items while allowing small items and fluids to pass through.

As used herein, the word "pivot" is intended to include any mechanical arrangement that allows for rotational motion. Non-limiting examples of pivots may include hinges, holes, posts, dowels, pins, points, rods, shafts, balls, and sockets, either individually or in combination.

As used in this disclosure, "vertical" refers to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claimed is:

1. A sidewall-suspended boat cooler comprising:

a container and a lid;

wherein the container and the lid are insulated to maintain the temperature of items placed within the container;

wherein the container has an asymmetric layout comprising a front compartment and a rear descending wall overhang where the front compartment and the rear descending wall overhang are separated by a U-shaped space that mates with a gunwale or sidewall of a vessel;

wherein the container comprises a front wall, a rear wall, a left wall, a right wall, and a bottom;

wherein the front wall, the left wall, the rear wall, and the right wall are vertically oriented walls that couple to each other to surround the container;

wherein the tops of the front wall, the left wall, the rear wall, and the right wall define an access opening through which the items are placed into or removed from the container;

wherein the bottom comprises an upper surface, a lower surface, and a transition wall;

wherein the upper surface is a horizontally oriented surface that couples to the rear wall, the left wall, and the right wall.

2. The sidewall-suspended boat cooler according to claim 1 wherein the lower surface is a horizontally oriented surface that couples to the front wall, the left wall, and the right wall;

wherein the lower surface is coupled to the bottom of the front wall, the bottom of the left wall, and the bottom of the right wall;

wherein the lower surface defines the deepest portion of an interior of the container.

3. The sidewall-suspended boat cooler according to claim 2 wherein the transition wall and the upper surface, in conjunction with the rear wall of the container, define the U-shaped space when viewed from a side of the container.

4. The sidewall-suspended boat cooler according to claim 3 wherein the sidewall-suspended boat cooler is supported by the gunwale or sidewall by placing the sidewall-suspended boat cooler on top of the gunwale or sidewall and lowering the container onto the gunwale or sidewall such that the U-shaped space straddles the gunwale or sidewall with the rear wall on one side of the gunwale or sidewall and the front compartment on the other side of the gunwale or sidewall.

5. The sidewall-suspended boat cooler according to claim 4 wherein the lid is a covering for the sidewall-suspended boat cooler that is hingedly coupled to the rear wall of the container via one or more hinges.

6. The sidewall-suspended boat cooler according to claim 5 wherein the lid pivots between an open position and a closed position;

wherein when in the open position, the items are placed into or removed from the container;

wherein when in the closed position, the lid and the container form a thermal barrier surrounding the items within the container.

7. The sidewall-suspended boat cooler according to claim 6 wherein the front wall, the left wall, the rear wall, the right wall, the bottom, and the lid are composed of and/or filled with a thermally insulating material.

8. The sidewall-suspended boat cooler according to claim 7 wherein a seal is coupled to the access opening at the tops of the front wall, the left wall, the rear wall, and the right wall;

wherein the seal prevents air from entering or exiting the interior of the container when the lid is closed.

9. The sidewall-suspended boat cooler according to claim 8 wherein the front wall, the left wall, the right wall, the lower surface, the transition wall, and the lid define the front compartment which is the front section of the sidewall-suspended boat cooler;

wherein the front compartment defines the largest storage area for the items placed within the container;

wherein the front compartment includes all space in the interior of the container directly above the lower surface and extending from the lower surface to the lid.

10. The sidewall-suspended boat cooler according to claim 9 wherein a lesser amount of storage space is proved adjacent to the front compartment at the rear of the container in the space directly above the upper surface and extending from the upper surface to the lid.

11. The sidewall-suspended boat cooler according to claim 10 wherein a left handle is hingedly coupled to the exterior of the left wall and a right handle is hingedly coupled to the exterior of the right wall;

wherein the sidewall-suspended boat cooler is lifted and carried using the left handle and the right handle.

12. The sidewall-suspended boat cooler according to claim 11 wherein the sidewall-suspended boat cooler comprises an organizer;

wherein the organizer provides storage space on the exterior of the container for the items that do not require thermal protection.

13. The sidewall-suspended boat cooler according to claim 12 wherein the organizer is a wall projecting from the front wall on the exterior of the container;

wherein the vertical height of the organizer is lower than the vertical height of the front wall;

wherein the organizer is U-shaped when viewed from above;

wherein the organizer has an organizer bottom to prevent the items laced in the organizer from falling through.

14. The sidewall-suspended boat cooler according to claim 13 wherein the organizer bottom comprises apertures for water to drain out of the organizer.

15. The sidewall-suspended boat cooler according to claim 14 wherein the sidewall-suspended boat cooler comprises a cargo net;

wherein the cargo net provides additional storage outside of the container;

wherein the cargo net is a mesh barrier that hangs adjacent to the front, exterior of the container.

16. The sidewall-suspended boat cooler according to claim 15 wherein the cargo net couples to the container via a net mounting hardware.

17. The sidewall-suspended boat cooler according to claim 16 wherein the net mounting hardware comprises a plurality of net hooks located on the exterior of the container that mate with a plurality of net hanging clips coupled to the cargo net.

* * * * *